United States Patent [19]

Sackenreuter et al.

[11] 4,004,363

[45] Jan. 25, 1977

[54] ROTATABLE CARTRIDGE CHAMBER FOR FIREARM TYPE WEAPON

[75] Inventors: Hans Sackenreuter, Ruckersdorf; Anton Politzer, Lauf, both of Germany

[73] Assignee: DIEHL, Nurnberg, Germany

[22] Filed: Jan. 13, 1975

[21] Appl. No.: 540,684

[30] Foreign Application Priority Data

Jan. 14, 1974 Germany ..... 2401543

[52] U.S. Cl. ..... 42/9; 42/39.5

[51] Int. Cl.[2] ..... F41C 11/00; F41C 13/00

[58] Field of Search ..... 42/9, 15, 39.5, 59, 42/60; 89/33 MC, 4 A, 13 R, 17, 155, 156, 126

[56] References Cited

UNITED STATES PATENTS

| | | | |
|---|---|---|---|
| 10,520 | 2/1854 | Cook | 42/9 |
| 38,772 | 6/1863 | Underwood | 42/9 |
| 39,232 | 7/1863 | Howard | 42/9 |
| 913,756 | 3/1909 | McCarty | 42/59 |
| 1,294,636 | 2/1919 | Dovell | 89/33 MC |
| 2,343,341 | 3/1944 | Sundquist | 42/59 |
| 2,790,353 | 4/1957 | Bird | 42/59 |
| 2,866,386 | 12/1958 | Lucht | 42/59 |
| 2,889,654 | 6/1959 | La Fever | 42/59 |

FOREIGN PATENTS OR APPLICATIONS

| | | | |
|---|---|---|---|
| 73,513 | 9/1944 | Czechoslovakia | 42/9 |
| 10,944 | 8/1844 | United Kingdom | 42/9 |

*Primary Examiner*—Charles T. Jordan
*Attorney, Agent, or Firm*—Walter Becker

[57] ABSTRACT

A rotatable cartridge chamber for a firearm type weapon in which the chamber is rotatable in the weapon at the rear end of the barrel and has cartridge chambers therein. The chamber receives cartridges from a magazine parallel to and adjacent the barrel in one rotated position and in another rotated position presents the cartridges projectile end foremost to the rear end of the barrel.

2 Claims, 6 Drawing Figures

Fig.2
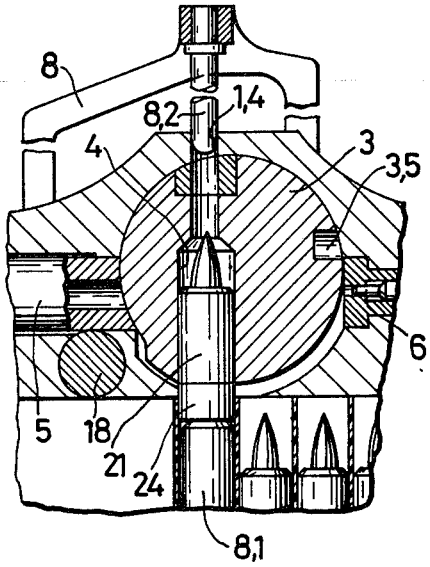
Fig.3
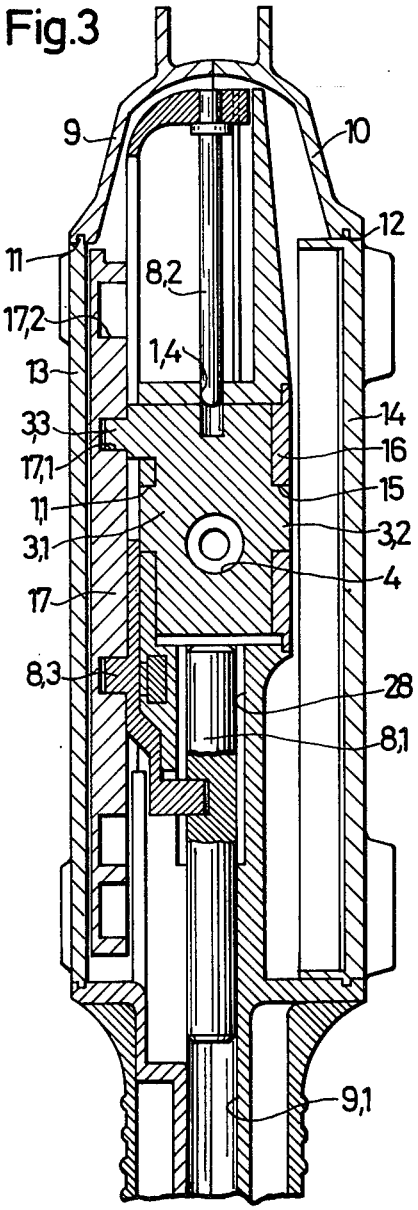
Fig.4
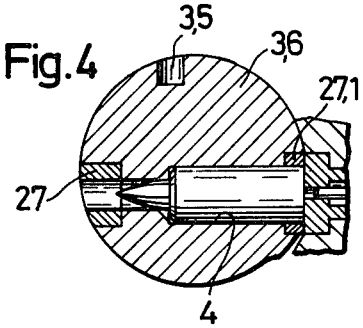
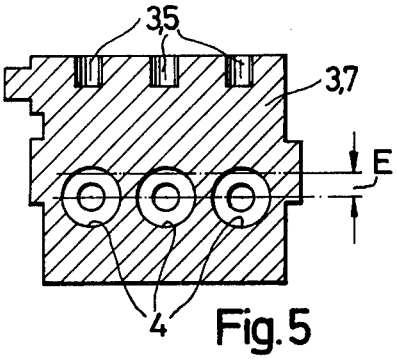
Fig.5

ROTATABLE CARTRIDGE CHAMBER FOR FIREARM TYPE WEAPON

The present invention relates to light tubular firearms with a pivotable cartridge chamber housing. Such a cartridge chamber housing is generally known as a cartridge cylinder, said cylinder receiving cartridges from a magazine arranged laterally of the weapon.

Manual firearms are known which comprise an ammunition drum or bar magazine (Stangenmagazin) adapted to be coupled to the respective firearm, from which magazine cartridges are fed to a longitudinally movable closure. Magazines of this type bring about that when they are intended to have a great capacity, the weapon becomes unhandy. This is due in particular to the fact that due to the type of the closure, the magazines have to be arranged in the direction transverse to the axis of the bore of the weapon.

It is, therefore, an object of the present invention to provide a weapon comprising only a few parts and having a sturdy closure arrangement, especially a pivotable cartridge chamber housing which permits the provision of a space-saving magazine arrangement in the weapon.

These and other objects and advantages of the invention will appear more clearly from the following specification in connection with the accompanying drawings, in which:

FIG. 1 is a cutout from a rifle with a cartridge chamber housing designed as a drum.

FIG. 1*a* illustrates on a larger scale than FIG. 1 the upper central portion of FIG. 1.

FIG. 2 shows the drum of FIG. 1 in the loaded position.

FIG. 3 is a cross section taken along the line III—III of FIG. 1.

FIG. 4 represents a drum, the cartridge chamber of which is at both sides thereof provided with sealing rings.

FIG. 5 shows a drum with three cartridge chambers.

Figure 1:
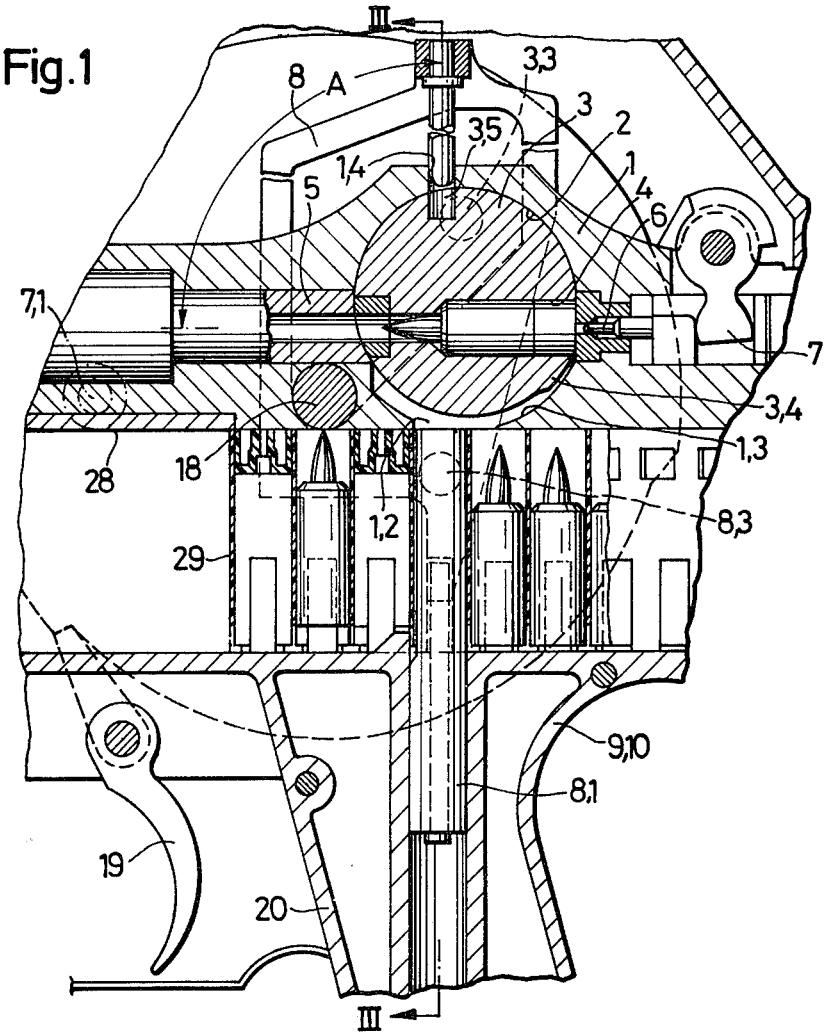

The weapon according to the present invention which is provided with a pivotable cartridge chamber housing is characterized primarily by a cartridge chamber housing which is journalled for pivoting transverse to the axis of the bore of the weapon and is in the form of a drum, the axis of rotation of said cartridge chamber housing being located eccentrically with regard to the axis of the bore of the weapon. The weapon is furthermore characterized by a magazine passage which is arranged on the housing side of the weapon and forms one plane with the axis of the bore.

In addition to the space-saving magazine passage arrangement for bar magazines of large capacity, such weapon will have a simple construction of the weapon housing while using only a few parts, and also the control and the design of the cartridge feeder and ejector require few parts only.

Referring now to the drawings in detail, in a rotation symmetrical recess 2 of a weapon housing 1 there is arranged a drum 3 with a cartridge chamber 4. Furthermore, the weapon housing 1 has received therein a barrel 5, firing pin or striker 6 with a hammer 7 and a cartridge inserter 8 and cartridge ejector.

The weapon housing 1 is closed off by two outer cups 9, 10 (FIG. 3) in a dust- and water-tight manner. These cups 9, 10 have lateral recesses 11, 12 into which covers 13, 14 have been inserted.

The drum 3 is by means of pivots 3.1, 3.2 (FIG. 3) centered in the bearing bore 1.1, 15 of the weapon housing 1 or a bearing disc 16 inserted into the weapon housing 1. The drive of the drum 3 is effected by means of a control disc 17 which is not described in detail and which through the intervention of a pivot 18 is likewise mounted in the weapon housing 1 (FIG. 1).

For driving and controlling the drum 3, a pivot 3.3 engages a cam 17.1 of the control disc 17. Adjacent the cam 17.1 there is provided an additional cam 17.2.

The drive of the control disc 17 can be effected in a known manner either by a gas pressure drive or by a motor driven by an outside source. For releasing and initiating a shot, there is provided a trigger 19 which is pivotally mounted on the cups 9 and 10, and there is furthermore provided a pistol grip 20. On the closure side, the drum 3 has a circular shaped bead 3.4 (FIGS. 1 and 1*a*). In conformity with the radius of the bead 3.4, there is provided a recess 1.3 in the weapon housing 1 within the region of a charging opening 1.2 and within a region corresponding to the pivot range of the bead 3.4. Furthermore the drum 3 is provided with a resting bore 3.5.

Figure 1A:
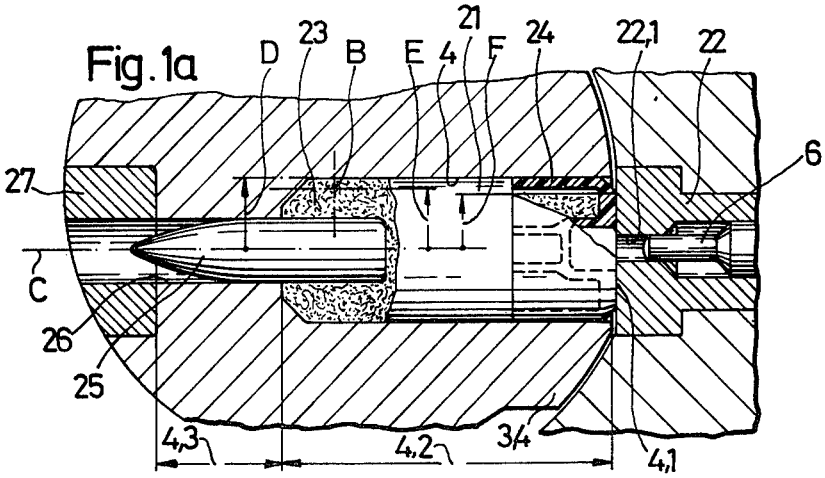

In conformity with FIG. 1, the axis of rotation B of the cartridge chamber 4 is eccentrically located by an eccentricity E relative to the axis of the bore or the cartridge chamber axis C. The eccentricity E is less than the radius D but is slightly greater than the radius F of an end face 4.1 located on the closure side and pertaining to cartridge 21. The eccentricity E may slightly correspond to the radius F. When E<F, the cartridge 21 will when pivoting into the axis C of the bore abut the closure chamber 22 thereby bringing about a jamming.

The cartridge chamber 4 is divided into two sections 4.2, 4.3 (FIG. 1*a*). The section 4.2 receives a sleeveless propelling charge 23 with a comsumption seal 24 (Verbrauchseichtung). The section 4.3 has a bore 26 for a projectile 25 connected to the propelling charge 23. This bore 26 is sealed relative to the barrel 5 and the weapon housing 1 by means of a packing 27. The striker 6 is guided in a bore 22.1 of the closure member 22.

As will be seen from FIG. 2, the cartridge inserter or cartridge ejector 8 has two push rods 8.1 and 8.2 which are coaxially arranged with regard to the cartridge chamber axis C. The push rods 8.1, 8.2 are alternately movable toward the cartridge chamber 4. This cartridge inserter and ejector 8 is likewise controlled by the control disc 17 or control cam 17.2 (FIG. 3). To this end the cartridge inserter 8 has a pivot 8.3 which is more clearly shown in FIGS. 1 and 3. The push rods 8.1, 8.2 will during a stroke slide into a bore 1.4 of the weapon housing 1 and 9.1 of the cups 9 and 10.

The drive of the striker or firing pin 6 is effected by the pivotally mounted hammer 7 which is operable by the control disc 17 and through a pivot 7.1 (FIG. 1) or non-illustrated lever at the bottom side of the weapon housing 1 there is provided a magazine passage 28 (FIGS. 1,3) of rectangular cross section, said passage 28 being arranged in the axial direction of the axis of the bore and confined by the cups 9, 10.

FIG. 4 shows a drum 3.6 the cartridge chamber 4 of which has seals 27, 27.1 on both sides. This design is not suitable for sleeveless ammunition.

A drum 3.7 shown in FIG. 5 has three cartridge chambers 4 which are arranged in one plane and intended for a weapon with three barrels. The eccentricity E corresponds to the eccentricity of that referred to above in connection with FIG. 1*a*.

The insertion into the drum 3 of a cartridge 21 in the magazine passage 28 and in a loading strip 29 is effected with a consumption seal 24 by means of the push rod 8.1 of the cartridge inserter 8. Subsequently, the drum 3 pivots by 90° with the cartridge 21 into the axis C of the bore and is here secured by means of the push rod 8.2 and the arresting bore 3.5. Thereupon the hammer 7 accelerates the striker 6 which ignites the cartridge 21 and thus drives the projectile 25 through the barrel. The described functional events are brought about by the control disc 17. These functions also occur with a weapon with the drum 3.7 described in connection with FIG. 5 while at the same time or cyclewise three bullets are fired.

It is, of course, to be understood that the present invention is, by no means, limited to the specific showing in the drawings but also comprises any modifications within the scope of the appended claims.

What is claimed is:

1. In a firearm type weapon having barrel means with bore means therein along which projectile means is impelled when the weapon is discharged, rotatable cartridge chamber housing means at the rearward end of said barrel means having a first rotated position for presenting cartridges which include said projectile means to the said bore means, said housing means comprising a drum rotatable on an axis transverse to the plane of the bore means and having chamber means therethrough for supporting the cartridges, the axis of rotation of said drum being offset laterally from the plane of the bore means, a magazine for cartridges adjacent said barrel means, and means operable in a second rotated position of the drum for transferring cartridges from said magazine to the chamber means in said drum, said drum including a peripheral recess which faces said magazine in the first rotated position of said drum and which terminates short of said chamber means, said drum having a head portion thereon between the end of said chamber means which is remote from said barrel means and the end of said recess nearest thereto.

2. In a firearm type weapon having barrel means with bore means therein along which projectile means is impelled when the weapon is discharged, rotatable cartridge chamber housing means at the rearward end of said barrel means having a first rotated position for presenting cartridges which include said projectile means to the said bore means, said housing means comprising a drum rotatable on an axis transverse to the plane of the bore means and having chamber means therethrough for supporting the cartridges, the axis of rotation of said drum being offset laterally from the plane of the bore means, a magazine for cartridges adjacent said barrel means, and means operable in a second rotated position of the drum for transferring cartridges from said magazine to the chamber means in said drum, the axis of rotation of said drum being offset from the plane of said bore means in a direction away from said magazine, said drum having a surface thereon at the end of said chamber means which faces away from said barrel means in said first rotated position of said drum which is planar and perpendicular to the axis of said chamber means, said weapon having a planar surface facing said barrel means and which is disposed in parallel opposed relation to the said surface on said drum in said first rotated position of the drum.

* * * * *